United States Patent [19]

Umezawa

[11] Patent Number: 4,732,376

[45] Date of Patent: Mar. 22, 1988

[54] BLANK CONVEYING APPARATUS

[75] Inventor: Fumiaki Umezawa, Kanagawa, Japan

[73] Assignee: Aida Engineering Limited, Sagamihara, Japan

[21] Appl. No.: 11,631

[22] Filed: Feb. 6, 1987

[30] Foreign Application Priority Data

Apr. 30, 1986 [JP] Japan ..... 61-101789

[51] Int. Cl.[4] ..... B65H 5/04

[52] U.S. Cl. ..... 271/267; 271/14; 271/193; 271/194; 294/65; 414/752; 414/900

[58] Field of Search ..... 271/14, 18.1, 90, 91, 271/93, 144, 267, 268, 193, 194; 294/65; 414/752, 900

[56] References Cited

U.S. PATENT DOCUMENTS 3,122,242 2/1964 Lopez ..... 414/900 X 3,888,359 6/1975 Moline ..... 271/267 X

*Primary Examiner*—Richard A. Schacher

*Attorney, Agent, or Firm*—Sandler & Greenblum

[57] ABSTRACT

This invention relates to an apparatus suitable for conveying shaped blanks. This apparatus includes a pair of screw shafts extending in a direction of conveying the blank. Members for holding attracters threadably coupled to these screw shafts are movable along guide shafts. Respectively provided at the ends of the guide shafts on one side are connecting members. Screw shafts threadably coupled to these connecting members drives the attracter holding members to approach or separate from each other on a line connecting the two guide shafts. Pinions provided near the opposite ends of the guide shafts rotatably move on racks, whereby the attracter holding members are synchronously moved in parallel to each other.

8 Claims, 4 Drawing Figures

BLANK CONVEYING APPARATUS

BACKGROUND OF THE INVENTION

1. Field of the Invention

This invention relates to a blank conveying apparatus for delivering each of blanks taken out by a blank supplying apparatus to feed bars of a transfer press machine, and particularly to one suitable for conveying heterogeneously shaped blanks and perforated blanks.

2. Description of the Prior Art

Normally, a blank conveying apparatus is provided between a position where a blank is taken out by a blank supplying apparatus and a position where a blank is delivered to and received by feed bars of a transfer press machine.

Such a conventional blank conveying apparatus has been known that a distance between the position where the blank is taken out and the position where the blank is delivered to and received by the feed bars is equidistantly divided and the blank is conveyed by one pitch of the divided sections as a conveying stroke. Grip jaws or attracters for grasping the blank are successively provided on a movable member for every pitches of the conveying stroke. By reciprocating the movable member by the pitch of the conveying stroke, the blank at the blank take-out position is conveyed by the pitch of the conveying stroke, and finally, delivered to and received by the feed bars.

There has recently been adopted such a construction of the blank conveying apparatus, wherein, to correspond to the blanks of various types, the grip jaws, attracters or the like for grasping the blanks are uniformly and positionally adjustably provided in a conveying direction of the blank.

However, in this construction, all of the attracters or the like are only uniformly adjustably provided in the conveying direction of the blank, so that this construction cannot correspond to the shaped blanks and perforated blanks. For example, in the case of the shaped blank shown in FIG. 4, if an attracter 100A on one side is made to correspond to the blank, then an attracter 100B on the other side gets out of place, so that these shaped blank and the like cannot be made to correspond thereto after all.

SUMMARY OF THE INVENTION

An object of the present invention is to provide a blank conveying apparatus applicable to the shaped blank and perforated blank or the like.

According to the present invention, the attracters in the respective rows are made positionally adjustable in the conveying direction of the blank, made adjustable in a direction perpendicular to the direction of conveying the blank, and, as necessary, these positional adjustments can be made independently of one row to another.

The blank conveying apparatus according to the present invention comprises: a frame; a movable member supported by this frame and provided in a manner to be freely reciprocated with a predetermined pitch of a conveying stroke in a direction parallel to the conveying direction of the blank; driving means for reciprocating the movable member; a plurality of screw shafts provided on the movable member in parallel to one another in a moving direction of the movable member; a plurality of attracter holding members threadably coupled to the respective screw shafts at every pitches of the conveying stroke and each having an attracter; a plurality of guide shafts disposed in parallel to the respective screw shafts, for supporting the plurality of attracter holding members in a manner to be movable in the axial direction of the screw shaft and unrotatable; widthwise adjusting means for moving the guide shaft and the screw shaft, which are opposed to each other, respectively, in parallel to a plane of conveying the blank and in a direction perpendicular to the axial lines of the guide shaft and the screw shaft, independently of other guide shaft and screw shaft; and equalizer means for synchronizing the movements of opposite ends of the respective guide shafts.

Accordingly, when the respective screw shafts are rotated, the attracter holding members threadably coupled thereto move in the axial direction of the screw shafts, so that the attracter holding members in every rows can be moved in the conveying direction of the blank, independently of one another. The guide shafts and the screw shafts, which are opposed to each other, respectively, can be moved by the widthwise adjusting means in the direction perpendicular to the axial lines of the guide shafts and the screw shafts, i.e. in the widthwise direction of the blank, and the opposite ends of the respective guide shafts are moved in synchronism with each other by the equalizer means, so that the attracter holding members in every rows can be moved in the widthwise direction of the blank, independently of one another. Hence, the attracter holding members in every rows can be adjusted in the conveying direction of the blank and the widthwise direction perpendicular to the conveying direction of the blank, independently of one another, so that the blank conveying apparatus can correspond to the shaped blank and the perforated blank or the like.

DETAILED DESCRIPTION OF THE PREFERRED EMBODIMENT

Figure 1:
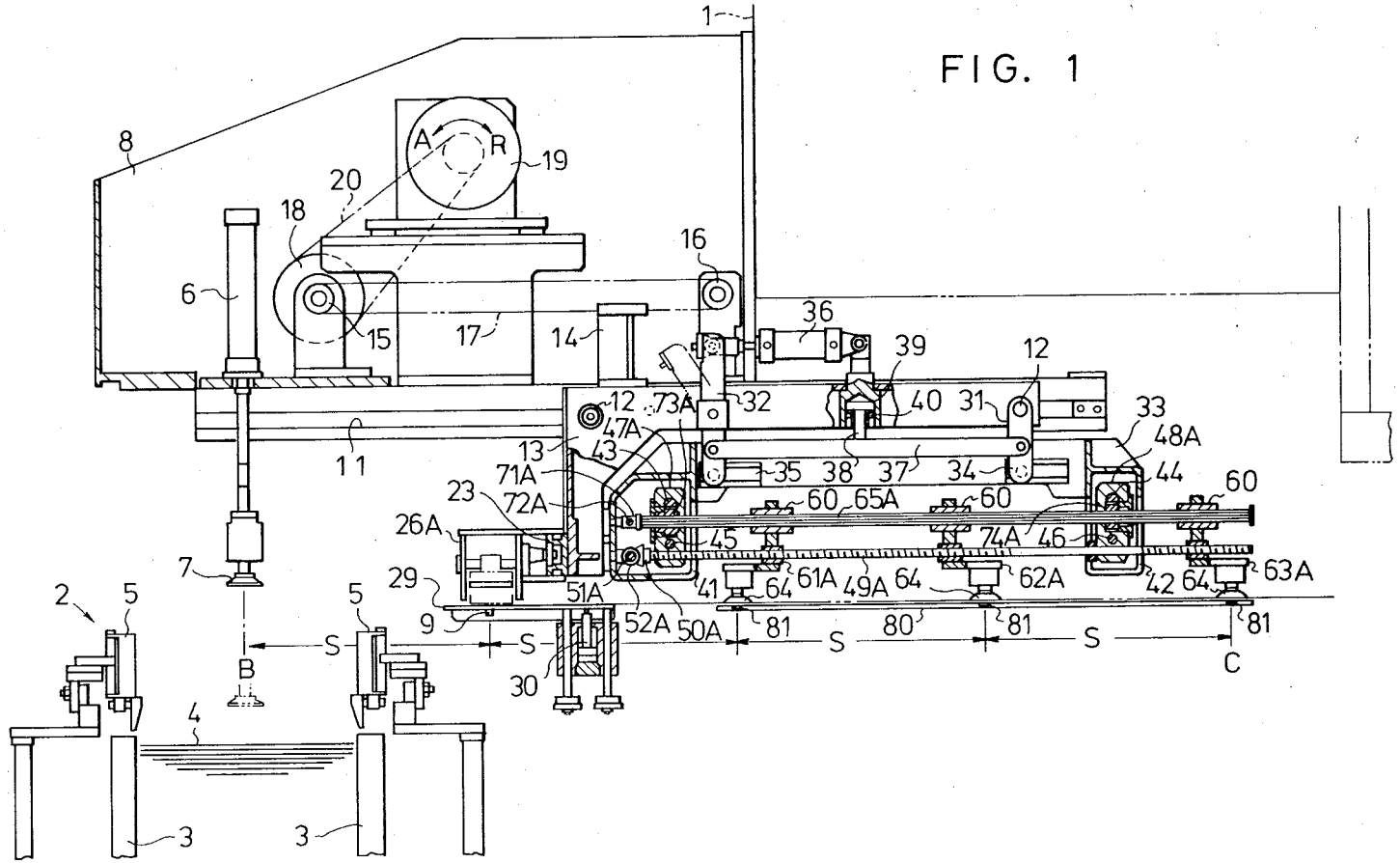
FIG. 1 is a front view generally showing the blank conveying apparatus according to the present invention.

FIG. 1 is a front view of this embodiment. Referring to the drawing, a blank supplying apparatus 2 is provided in the proximity the left side surface of a transfer press machine 1. The blank supplying apparatus 2 successively pushes up blanks 4 piled up between a plurality of guide bars 3 by use of a lift cylinder, not shown, from below, separates the uppermost blank 4 one after another by use of a magnet floater 5, and thereafter, the blank 4 thus separated is attracted to an attracter 7 of a cylinder 6 positioned upwardly of the blank 4 and taken out upwardly. The cylinder 6 is vertically supported by a frame 8 projectingly provided from the side surface of the press machine 1.

Provided at the lower portion of the frame 8 in a conveying direction of the blank 4 are two guide grooves 11 to guide a movable member 13. Engaged with the two guide grooves 11 are rollers 12 rotatably provided on the movable member 13. The movable member 13 can be reciprocated by means of these rollers 12. Fixed to the top surface of the movable member 13 is a connecting member 14, which is connected to a chain 17 provided in parallel to a moving direction of the movable member 13 through a pair of sprockets 15 and 16. Rotation of a reversibly rotatable motor 19 is transmitted through a chain 20 to the other sprocket provided concentrically with the sprocket 15 in the rear. In consequence, the movable member 13 makes advance-return motions due to the normal and reverse rotations of the motor 19. A conveying stroke pitch of the advance-return motions can be varied by a turning angle of the motor 19, and, in this case, a length S is set which is obtained by equidistantly dividing a distance from a blank supplying position B of the cylinder 6 to a position C where the blank 4 is delivered to an received by feed bars into four.

Figure 2:
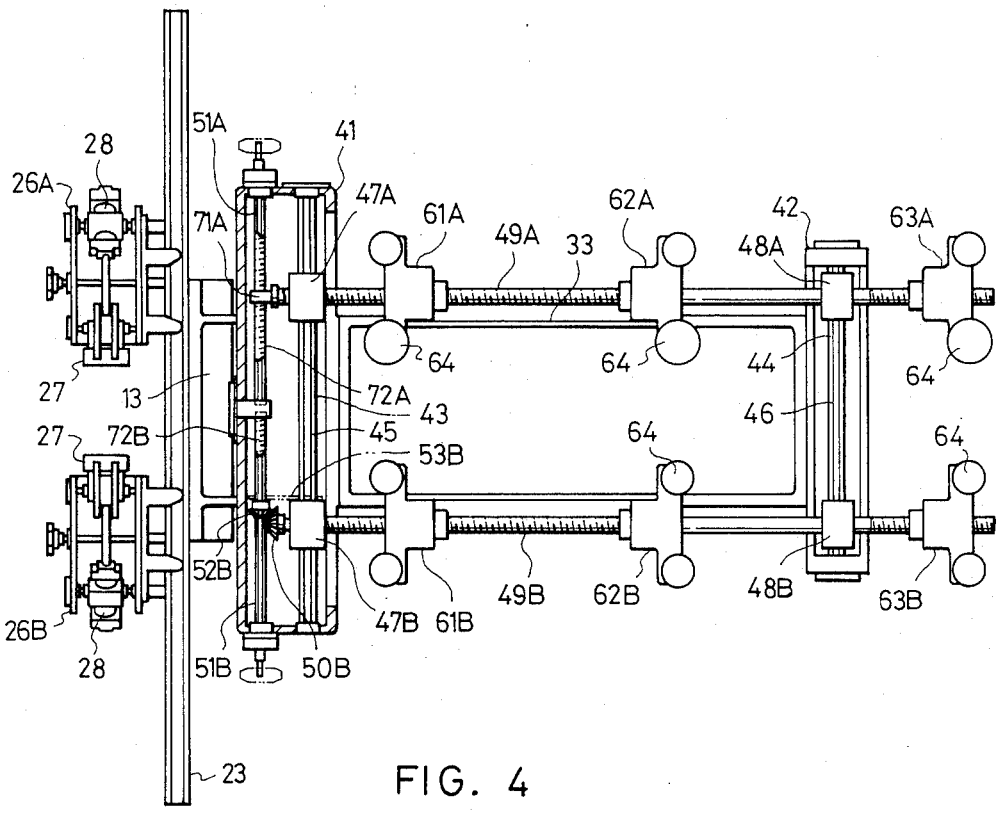
FIG. 2 is a bottom view showing the movable member portion.

As shown in FIG. 2, secured to the rear end face of the movable member 13 is a guide rail 23 in a direction perpendicular to the moving direction of the movable member 13. A pair of right and left grip jaws 26A and 26B are provided on the guide rail 23 in a manner to be movable, fixable and independently of each other. A distance from the grip jaws 26A and 26B to the blank supplying position B corresponds to the conveying stroke pitch S when the movable member 13 is in an advance position (a state shown in FIG. 1). The grip jaws 26A and 26B are each provided thereon with a pair of top and bottom pawls 27 openable and closable by the operation of a cylinder 28. Accordingly, only if a distance between the pair of grip jaws 26A and 26B is adjusted in accordance with a width of the blank 4, opposite sides of the blank 4 can be clamped by the pair of grip jaws 26A and 26B.

A table 29 vertically movable by the operation of a piston 30 is provided at a position downwardly of the grip jaws 26A and 26B in the state shown in the drawing. A magnet 9 is embedded in the top surface of this vertically movable table 29. With this arrangement, when the pair of grip jaws 26A and 26B receive the blank 4 from the attracter 7 of the cylinder 6 and move to the advance position, being accompanied by the movable member 13, the vertically movable table 29 is lifted by the operation of the piston 30. Here, when the pair of grip jaws 26A and 26B release the blank 4, the blank 4 is brought into a state of being attracted by the magnet 9 embedded in the top surface of the vertically movable table 29. Thereafter, the vertically movable table 29 is lowered to return to the initial position, while the grip jaws 26A and 26B return, being accompanied by the movable member 13.

Horizontally suspended from the undersurface of the movable member 13 through links 31 and 32 is a vertically movable member 33. The link 31 is rotatably supported at the top end thereof by the movable member 13 and slidably engaged at the bottom end thereof with an elongated groove 34 horizontally formed in the vertically movable member 33. The link 32 is rotatably supported at the intermediate portion thereof by the movable member 13 and slidably engaged in an elongated groove 35 horizontally formed in the vertically movable member 33. The link 32 is connected at the top end thereof to a piston rod of a cylinder 36 rotatably supported on the top surface of the movable member 13. The two links 31 and 32 are connected to each other by a horizontal connecting rod 37, and a vertical shaft 38 is projected from the intermediate position of this connecting rod 37. The upper portion of the shaft 38 is inserted into a hole 39 formed in the movable member 13 through a spherical bearing 40. When the cylinder 36 moves linearly, the both links 31 and 32 rock in association therewith, whereby the vertically movable member 33 is raised or lowered, i.e. makes lift-down motions. In this case, a force directed in the moving direction of the movable member 13 acts on the vertically movable member 33. However, since the vertically movable member 33 is prevented by the shaft 38 from moving in the moving direction of the movable member 13, whereby the vertically movable member 33 moves only in the vertical direction.

Figure 3:
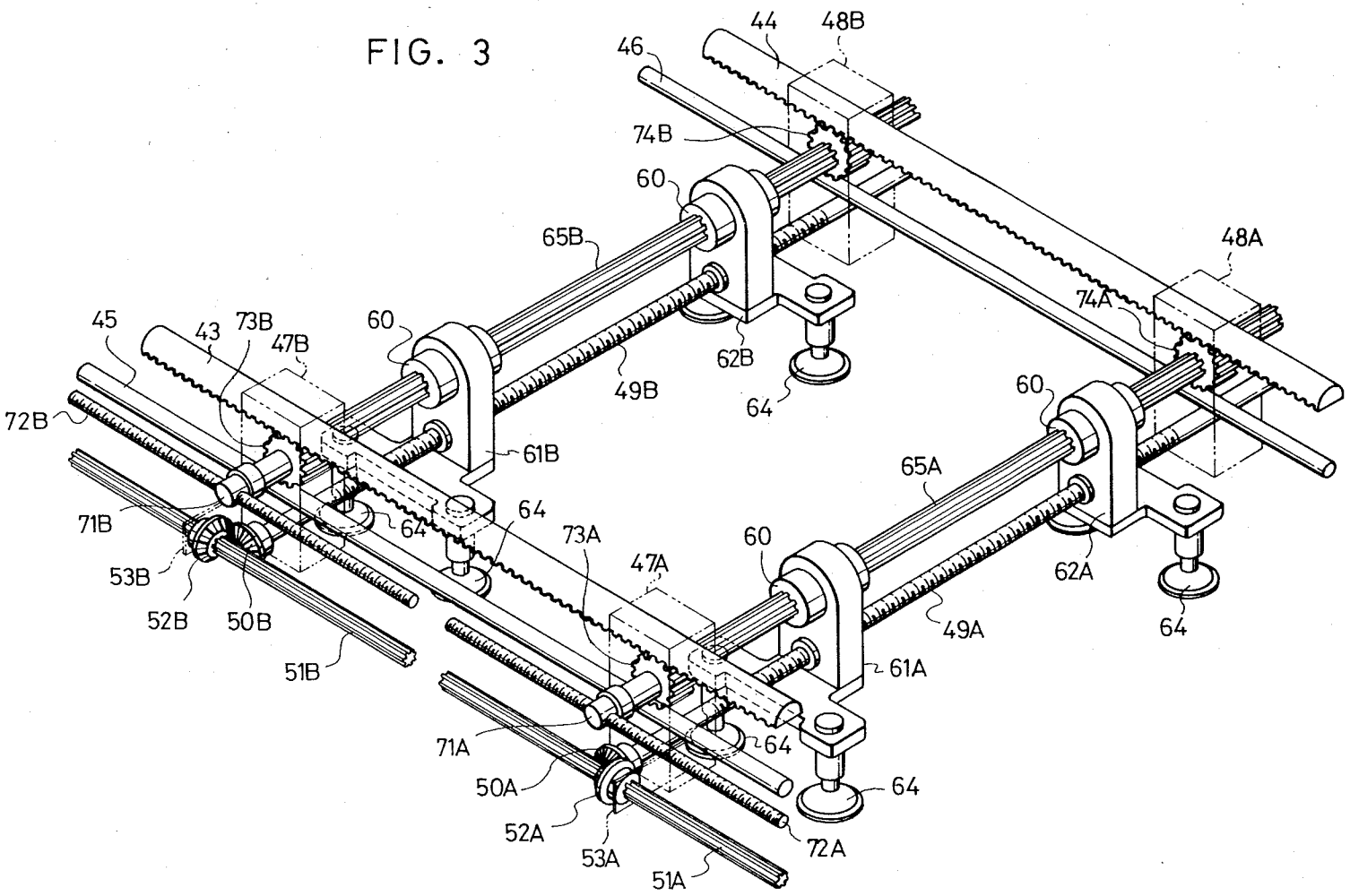
FIG. 3 is a perspective view showing a mechanism for moving the attracter holding members.

The vertically movable member 33 is provided in front and in the rear thereof with a pair of frames 41 and 42. As shown in FIGS. 2 and 3, in the respective frames 41 and 42, rack members 43 and 44, and guide bars 45 and 46 are supported in the vertical direction and in a direction perpendicular to the moving direction of the movable member 13, respectively. The rack member 43 and the guide bar 45, which are opposed to each other in the vertical direction, are movably provided thereon with a pair of right and left movable blocks 47A and 47B. Also, the rack member 44 and the guide bar 46, which are opposed to each other in the vertical direction, are movably provided thereon with a pair of right and left movable blocks 48A and 48B.

Screw shafts 49A and 49B are rotatably and penetratingly provided in parallel to the moving direction of the movable member 13 across the movable blocks 47A and 48A and across the movable blocks 47B and 48B, respectively. Bevel gears 50A and 50B are fixed to the rear ends of the screw shaft 49A and 49B, respectively. Brought into engage with these bevel gears 50A and 50B are bevel gears 52A and 52B, which are slidably engaged with spline shaft 51A and 51B, which perpendicularly intersect the screw shafts 49A and 49B. The bevel gears 52A and 52B are moved by abutting plates 53A and 53B, which are provided on the movable blocks 47A and 47B, along the spline shafts 51A and 51B, simultaneously with the movable blocks 47A and 47B. The spline shafts 51A and 51B are rotatably supported in parallel to the axial lines of the rack member 43 and the guide bar 45 and independently of each other in the frame 41, and the outer ends thereof are protruded outwardly from the frame 41. In consequence, handles or the like are fastened to the protruding ends of the spline shafts 51A and 51B, and, when these handles are turned, rotations of the spline shafts 51A and 51B are imparted to the screw shafts 49A and 49B, respectively, through the bevel gears 52A, 52B and 50A, 50B, so that the screw shafts 49A and 49B can be rotated independently of each other.

The screw shaft 49A is threadably coupled thereto with three attracter holding members 61A, 62A and 63A at every conveying stroke pitches from the grip jaw 26A. Also, the screw shaft 49B is threadably coupled thereto with three attracter holding members 61B, 62B and 63B at every conveying stroke pitches from the grip jaw 26B. Pairs of right and left attracters 64 are replaceably mounted to opposite sides of undersurfaces of the attracter holding members 61A–63A and 61B–63B in every rows. Engageable members 60 each having a spline holes are rotatably held by the upper portions of the attracter holding members 61A–63A and 61B–63B in every rows. Penetrating through the engageable members 60 in every rows are spline shafts 65A and 65B as being guide shafts for supporting these attracter holding members 61A–63A and 61B–63B in a manner to be movable in the axial directions of the screw shafts 49A and 49B and unrotatable. The spline shafts 65A and 65B are rotatably supported across the movable blocks 47A and 48A and across 47B and 48B, which are opposed to each other in the longitudinal directions, and in parallel to the axial lines of the screw shafts 49A and 49B. When the screw shafts 49A and 49B are rotated, the attracter holding members 61A–63A and 61B–63B in every rows, being regulated in rotation by the spline shafts 65A and 65B, are moved in the axial directions of the screw shafts 49A and 49B.

Connecting members 71A and 71B are secured to the rear ends of the spline shafts 65A and 65B in a manner to be rotatable relative to the spline shafts 65A and 65B. Threadably coupled to these connecting members 71A and 71B are other screw shafts 72A and 72B, which perpendicularly intersect the spline shafts 65A and 65B, respectively. The screw shafts 72A and 72B are rotatably supported in parallel to the axial lines of the spline shafts 51A and 51B and independently of each other in the frame 41, and the outer ends thereof are protruded outwardly from the frame 41. Handles or the like are fastened to the protruding ends of the screw shafts 72A and 72B, and, when the handles are rotated, the connecting members 71A and 71B, which are threadably coupled to the screw shafts 72A and 72B, move in the axial directions of the screw shafts 72A and 72B, i.e. the widthwise direction of the blank 4, so that the positions of the attracter holding members 61A–63A and 61B–63B in every rows in the widthwise direction thereof can be adjusted independently of one another. Here, widthwise adjusting means is constituted by the connecting members 71A and 71B, and the screw shafts 72A and 72B.

Fixed to the opposite sides of the spline shafts 65A and 65B are pinions 73A, 73B, 74A and 74B, which are in mesh with the rack members 43 and 44. When the connecting members 71A and 71B tend to move in the axial directions of the screw shafts 72A and 72B due to rotation of the screw shafts 72A and 72B, the pinions 73A, 73B, 74A and 74B, being in mesh with the rack members 43 and 44, rotate, so that the movement values at the opposite ends of the spline shafts 65A and 65B can be made equal to each other. Here, equalizer means is constituted by the rack members 43 and 44, and pinions 73A, 73B, 74A and 74B.

Provided at positions downwardly of the attracter holding members 61A–63A and 61B–63B is a chute 80 through supporting means, not shown. On this chute 80, magnets 81 are embedded at every conveying stroke pitches. With this arrangement, the blank 4 is attracted by the attracters 64 and successively conveyed, using the respective magnets 81 as relay points.

Description will hereunder be given of action of this embodiment.

In the state shown in FIG. 1, the blank 4 is attracted by the attracter 7 by lowering the cylinder 6, and thereafter, the cylinder 6 is lifted. At the same time, the motor 19 is driven to return the movable member 13 by a conveying stroke pitch, and the opposite sides of the blank 4 is clamped by the pair of grip jaws 26A and 26B.

When the movable member 13 is advanced by a conveying stroke pitch by the reverse driving of the motor 19, the blank 4 clamped by the pair of grip jaws 26A and 26B is moved to the top surface of the vertically movable table 29. Here, the grip jaws 26a and 26B are released after the table 29 is lifted, the blank 4, which has been clamped by the grip jaws, is attracted by the magnets 9. Thereafter, the vertically movable table 29 is lowered, while, the movable member 13 is returned again. As described above, the pair of grip jaws 26A and 26B repeats actions, in each of which the blank 4 received from the attracter 7 of the cylinder 6 is delivered to and received by the vertically movable table 29 in association with the advance-return motions of the movable members 13.

On the other hand, the blank 4 on the vertically movable table 29 is successively conveyed by a conveying stroke pitch by the attracter holding members 61A–63A and 61B–63B in every rows in association with the advance-return motions of the movable member 13 and the lift-down motions of the vertically movable member 33, and delivered to and received by the feed bars of the transfer press machine.

More specifically, when the movable member 13 is returned, with the vertically movable member 33 being lifted, first attracter holding members 61A and 61B are positioned on the table 29. Here, when the vertically movable member 33 is lowered by the operation of the cylinder 36, the blank 4 positioned on the table 29 is attracted by the first attracter holding members 61A and 61B. Thereafter, the vertically movable member 33 is lifted by the operation of the cylinder 36.

In this state, the blank 4 attracted by the first attracter holding members 61A and 61B is conveyed by a conveying stroke pitch to the succeeding stage by the advance motion of the movable member 13. When the blank 4 is conveyed to the succeeding stage, the vertically movable member 33 is lowered again by the operation of the cylinder 36, and the blank 4 attracted by the first attracter holding members 61A and 61B is delivered onto the succeeding stage. Thereafter, the vertically movable member 33 is lifted by the operation of the cylinder 36 to return to the initial state.

The blank 4 delivered onto the first stage is successively conveyed to a second and third stages by second and third attracter holding members 62A, 62B, 63A and 63B in the same manner as described above, and finally, delivered to and received by the feed bars.

Figure 4:
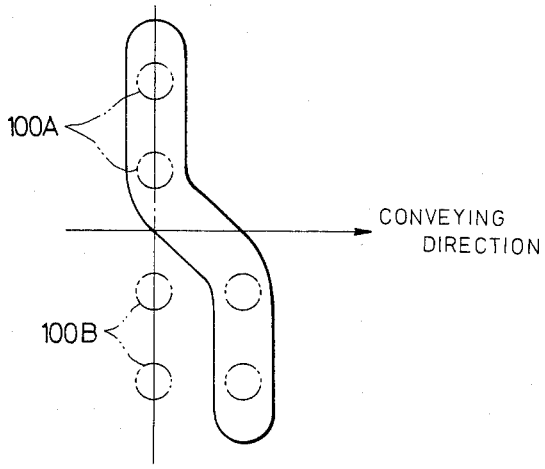
FIG. 4 is a plan view showing the shaped blank.

Now, assumption is made that the attracter holding members are applied to the blank shown in FIG. 4. First, a distance between the side of the attracter holding members 61A–63A and the side of the attracter holding members 61B–63B is adjusted in accordance with the width of the blank 4, and thereafter, the side of the attracter holding members 61A–63A is moved forwardly relative to the side of the attracter holding members 61B–63B.

In order to adjust the distance between the side of the attracter holding members 61A–63A and the side of the attracter holding members 61B–63B, the following operation should be made. Namely, when the both screw shafts 72A and 72B are rotated independently of each other, the spline shafts 65A and 65B parallelly move in a direction perpendicular to the axial line thereof, whereby the distance between the attracter holding members 61A–63A and 61B–63B should be made to correspond to the width of the blank 4. Since, at this time, movements of the opposite ends of the spline shafts 65A and 65B are synchronized with each other by the pinions 73A, 74A and 73B, 74B, and the rack members 43 and 44, no difference occurs between the movement values.

In order to move the side of the attracter holding members 61A–63A in the direction of conveying the blank 4 relative to the side of the attracter holding members 61B–63B, the spline shaft 51A is rotated. Then, rotation of the spline shaft 51A is transmitted to the screw shaft 49A through the bevel gears 52A and 50A, so that the attracter holding members 61A–63A which are threadably coupled to the screw shaft 49A, holding regular intervals therebetween, are moved in the axial direction of the screw shaft 49A. Therefore, the attracter holding members 61A–63A may be moved by means of the spline shaft 51A so as to correspond to the blank 4.

According to this embodiment, the positions of the sides of the attracter holding members 61A–63A and 61B–63B in the widthwise direction and the position of the blank 4 in the conveying direction are made to be adjustable independently of one another, so that this embodiment can be applied to the conveying of the shaped blank and the perforated blank.

To adjust the positions in the widthwise directions, the screw shafts 72A and 72B which perpendicularly intersect the spline shafts 65A and 65B should be rotated, so that the operation is very simplified. Moreover, the pinions 73A, 73B, 74A and 74B are provided at the opposite ends of the spline shafts 65A and 65B, and these pinions are brought into mesh with the rack members 43 and 44, so that the spline shafts 65A and 65B can be moved in parallel to each other at all times, with no difference occurring between the movement values at the opposite ends thereof.

To adjust the position in the conveying direction, the spline shafts 51A and 51B, which perpendicularly intersect the screw shafts 49A and 49B, should be rotated, so that the operation is very simplified.

In working the invention, the guide shafts for supporting the attracter holding members 61A–63A and 61B–63B in every rows in a manner to movable in the axial directions of the screw shafts 49A and 49B and unrotatable need not necessarily be limited to the spline shafts 65A and 65B, which are described in the above embodiment, and mere rods of a round shape or a square shape in cross-section may be adopted.

The widthwise adjusting means for moving the spline shafts 65A, 65B and the screw shafts 49A and 49B, which are opposed to each other, respectively, in the directions perpendicular to the axial lines thereof need not necessarily be limited to the screw shafts 72A and 72B, which are described in the above embodiment, and other constructions may be adopted. For example, such an arrangement may be adopted that spline shafts are provided in place of the screw shafts 72A and 72B, bevel gears are provided on theses spline shafts in a manner to be movable in synchronism with the movable blocks 47A and 47B, and bevel gears being in mesh with these bevel gears are fixed to the rear ends of the spline shafts 65A and 65B. With this arrangement, rotations of the spline shafts are transmitted to the spline shafts 65A and 65B through the bevel gears in mesh with each other, whereby the pinions 73A, 73B, 74A and 74B at the opposite ends of the spline shafts 65A and 65B move, while rotating relabive to the rack members 43 and 44.

The equalizer means need not necessarily be limited to the pinions 73A, 73B, 74A and 74B and the rack members 43 and 44 as described in the above embodiment, and sprockets and chains may be adopted.

There has been described the example wherein the two screw shafts 49A and 49B, and the two spline shafts 65A and 65B are provided, however, three or more screw shafts and spline shafts, respectively, may be provided for a further larger blank.

As has been described hereinabove, according to the present invention, the blank conveying apparatus applicable to the shaped blank and the perforated blank can be provided.

What is claimed is:

1. A blank conveying apparatus comprising:

a frame;

a movable member supported by said frame and provided in a manner to be freely reciprocated with a predetermined pitch of a conveying stroke in a direction parallel to the direction of conveying said blank;

a vertically movable member which is supported by said movable member in a manner to be movable in the vertical direction;

driving means for reciprocating said movable member;

a plurality of screw shafts provided on said vertically movable member in parallel to one another in a direction of moving of said movable member;

a plurality of attracter holding members threadably coupled to said screw shafts at every pitches of the conveying stroke and each having an attracter;

a plurality of guide shafts disposed in parallel to said screw shafts, for supporting said plurality of attracter holding members in a manner to be movable in the axial direction of said screw shafts and unrotatable;

widthwise adjusting means for moving said guide shafts and said screw shafts, which are opposed to each other, respectively, in parallel to a plane of conveying said blank and in a direction perpendicular to the axial lines of said guide shafts and said screw shafts, independently of other guide shafts and screw shafts; and equalizer means for synchronizing the movements of opposite ends of said guide shafts.

2. A blank conveying apparatus as set forth in claim 1, wherein said guide shafts are made to be spline shafts.

3. A blank conveying apparatus as set forth in claim 1, wherein said widthwise adjusting means is constituted by connecting members rotatably provided on ends of said guide shafts on one side and screw shafts each threadably coupled to said respective connecting member, disposed in a direction perpendicular to the axial lines of said guide shafts.

4. A blank conveying apparatus as set forth in claim 1, wherein said equalizer means is constituted by pinions provided at opposite ends of said guide shafts and a pair of rack members being in engagement with said pinions at the opposite ends and disposed in directions perpendicular to the axial lines of said guide shafts.

5. A blank conveying apparatus as set forth in claim 1, wherein said screw shafts and said guide shafts are formed of a set of two pairs of top guide shafts and bottom screw shafts in two rows.

6. A blank conveying apparatus as set forth in claim 1, wherein said screw shafts are driven separately of each other.

7. A blank conveying apparatus as set forth in claim 1, wherein said attracters are each formed of a sucking disc.

8. A blank conveying apparatus as set forth in claim 1, wherein said attracters is each constructed such that said blank is magnetically attracted.

* * * * *